US005965883A

United States Patent [19]

Lee et al.

[11] Patent Number: 5,965,883

[45] Date of Patent: Oct. 12, 1999

[54] CAPILLARY FOR ELECTROSPRAY ION SOURCE

[75] Inventors: Sang-Won Lee, Pasadena, Calif.; Thomas Schindler, Freising, Germany; Jesse L. Beauchamp, Pasadena, Calif.

[73] Assignee: California Institute of Technology, Pasadena, Calif.

[21] Appl. No.: 08/924,477

[22] Filed: Aug. 25, 1997

[51] Int. Cl.[6] ..... H01J 44/04

[52] U.S. Cl. ..... 250/288

[58] Field of Search ..... 250/288, 288 A

[56] References Cited

U.S. PATENT DOCUMENTS

| | | | |
|---|---|---|---|
| 4,999,493 | 3/1991 | Allen et al. | 250/288 |
| 5,015,845 | 5/1991 | Allen et al. | 250/288 |
| 5,245,186 | 9/1993 | Chait et al. | 250/288 |
| 5,289,003 | 2/1994 | Musser | 250/288 |
| 5,393,975 | 2/1995 | Hail et al. | 250/288 |
| 5,587,582 | 12/1996 | Henion et al. | 250/288 |
| 5,736,741 | 4/1998 | Bertsch et al. | 250/288 |

OTHER PUBLICATIONS

Fenn, et al., Electrospray Ionization for Mass Spectrometry of Large Biomolecules, *Science*, 246:64, Oct. 6, 1989.

*Primary Examiner*—Jack I. Berman
*Attorney, Agent, or Firm*—Fish & Richardson P.C.

[57] ABSTRACT

A capillary for use with an electrospray ion source includes a concentric outer capillary sleeve and inner capillary tube. An outer surface of the tube engages an inner surface of the sleeve. Conductors are formed at respective upstream and downstream ends of the capillary.

22 Claims, 2 Drawing Sheets

(PROR ART)

CAPILLARY FOR ELECTROSPRAY ION SOURCE

BACKGROUND

1. Technical Field

This invention relates to electrospray ion sources, and more particularly to capillaries useful for the transfer of ions generated by such sources.

2. Background Information

Electrospray ionization has become a common method of generating ions of sample material to be analyzed by mass spectrometers. An electrospray ion source, capillary assembly and mass spectrometer are shown in FIG. 1. In a spray chamber 2, substantially at atmospheric pressure, sample material is made to flow through a grounded conductive needle 4. A cylindrical wire screen electrode 6 typically surrounds the bulk of the chamber and is maintained at an appropriate potential. For example, a potential of −2500 volts is usual for electrospray of positive ions. Sample liquid emerges from the needle in a spray which forms the shape of a so-called "Taylor cone" 7 which breaks up into small charged liquid droplets at the tip. Evaporation yields smaller droplets and eventually sample ions. This stream of droplets and sample ions is directed into a downstream vacuum chamber 8 with a mass spectrometer 10 at its downstream end. The droplets and sample ions are guided to the capillary via an annular end electrode 12 at the downstream end of the spray chamber. In the case of positive ions the end electrode 12 would be at an even greater negative potential than the cylindrical electrode 6, for example at −3700 volts. The ions may then flow through the capillary under the influence of the pressure difference across the capillary.

A particular prior art capillary 20 is shown in greater detail in FIG. 2. The capillary comprises a unitary glass tube 21 having a cylindrical outer surface 23 and internal bore 22. With reference to its upstream to. downstream central longitudinal axis, the capillary is both radially symmetrical and symmetrical about its center along the axis. Each end of the tube has a slight bevel which, however, leaves a major central portion of the end remaining perpendicular to the axis. Conductors 26 are formed at each end of the capillary by a platinum coating (shown with extremely exaggerated thickness) which encompasses the outer surface of the tube 21 adjacent the tube's end as well as covering the end itself, excluding a central aperture 27 at the internal bore 23. Exemplary capillary dimensions are 7.125 inches long by 0.25 inches outer diameter by 0.025 inches internal diameter.

Electrical contacts (not shown) engage the capillary conductors to maintain the conductors at desired voltages to establish the space potential at the upstream and downstream ends of the bore. The upstream electrode of the capillary is maintained at an extreme negative potential, such as −4500 volts, than is the end electrode 12. The downstream conductor of the capillary may form the first stage of a multistage lensing system 14 for the final direction of the ions to the spectrometer. Typically, such lensing systems involve smaller absolute potentials than in the spray chamber, for example placing the downstream capillary conductor at a potential of 160 volts with subsequent lenses decrementing to −80 volts. In addition to the multiple voltage stages, multiple pressure stages may be provided to bring the pressure down to the ultimate pressure at the spectrometer of, for example, $10^{-5}$ torr. The voltages are typically reversed when using negative ions.

The foregoing discussion is, of necessity, a brief discussion of the functioning of electrospray ion sources and associated spectrometers. A number of ion sources are commercially available which would be suited for use with capillaries of the present invention. Exemplary units include those produced by Analytica of Branford, Inc., Branford, Conn., and supplied with spectrometers of Hewlett Packard.

Often, the interior surface of the capillary acquires deposits over time—typically of less volatile samples such as peptides or salts. Often the gold or platinum coating forming the conductors becomes damaged by electric discharges or field-induced oxidation, particularly in configurations wherein the electrospray needle is located particularly close to the capillary. This configuration is useful for microelectrospray or nanoelectrospray sources wherein particularly small volumes of sample material are involved.

A changeout of the capillary may be necessary, to replace it with a cleaner capillary or a different type of capillary, such as one having a different internal diameter or one having a desired conductivity. For changeout, the source may be turned off to stop the flow of ions through the capillary. The spray chamber may be opened to provide access to the capillary which is extracted from its retainer. The extraction of the capillary from its retainer permits an inflow of air into the low pressure chamber, breaking the vacuum. After changeout, it may take significant time, sometimes on the order of days, to reestablish the desired vacuum.

SUMMARY

Accordingly, the present invention facilitates the provision of a capillary which may be easily serviced or remanufactured, even in situ in a vacuum system wherein an upstream capillary end is exposed to ambient atmospheric pressure and a generally downstream end is under vacuum. Such a capillary may comprise a generally concentric outer capillary sleeve and inner capillary tube, each substantially annular in section over at least a major portion of its length, an outer surface of the tube engaging an inner surface of the sleeve. Upstream and downstream conductors are borne at respective upstream and downstream ends of the capillary. The inner capillary tube may be withdrawn from the outer capillary sleeve without damage to the sleeve and subsequently replaced with the same type, or a different type, of inner capillary tube.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference numbers and designations in the various drawings indicate like elements.

DETAILED DESCRIPTION

Capillaries according to the present invention may be made with such dimensions and proportions as to be fully interchangeable with corresponding prior art capillaries for use with existing electrospray ion sources.

Figure 1:
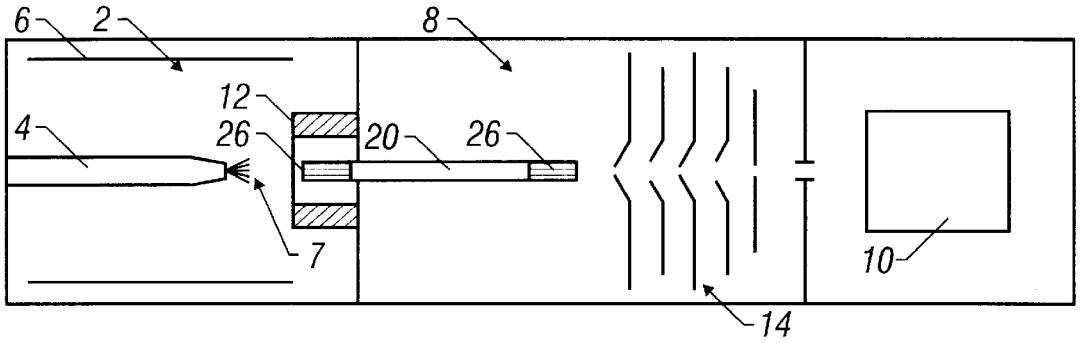
FIG. 1 (PRIOR ART)
FIG. 1 is a schematic view of an electrospray ion source, capillary system and spectrometer.
Figure 2:
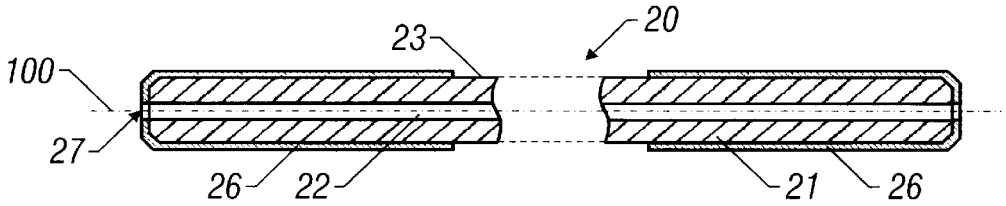
FIG. 2 is a partial cut-away cross-sectional view of a prior art capillary.
Figure 3:
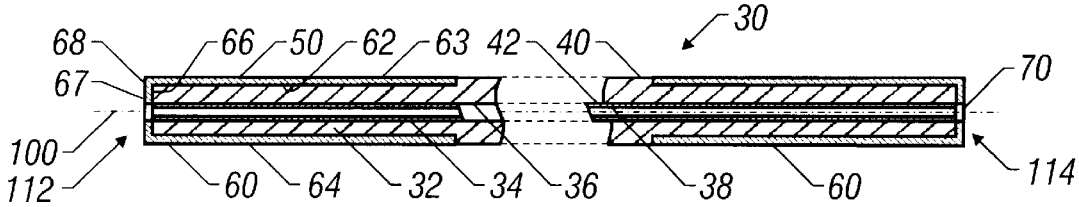
FIG. 3 is a partial cut-away cross-sectional view of a first capillary according to one embodiment of the invention.

The capillary 30, shown in FIG. 3, comprises an outer capillary sleeve 32 surrounding an inner capillary tube 34. The sleeve 32 and tube 34 have substantially cylindrical respective inner surfaces 36 and 38 and outer surfaces 40 and 42. The inner surface, or bore of the capillary 30 is substantially formed by the inner surface 38 of the tube and the outer surface of the capillary is substantially formed by the outer surface 40 of the sleeve 32. The capillary is substantially radially symmetrical about its central longitudinal axis 100 extending from an upstream end 112 to a downstream end 114. At each end, the capillary has a conductive end cap 60 comprising the unitary combination of a tubular body 63 having cylindrical inner and outer surfaces 62 and 64, respectively, and an end plate 67 having inner and outer surfaces 66 and 68 with a central aperture 70. The body 63 of the end cap 60 encompasses and is in circumferential engagement with a reduced diameter portion 50 of the sleeve 32 adjacent the end of the capillary. The external diameter of external end cap surface 64 is substantially the same as that of external sleeve surface 40.

In an exemplary embodiment of the capillary of FIG. 3, the sleeve 32 is formed of polyetheretherketone ("PEEK") with an external diameter of 0.25 inches and an internal diameter of 0.0625 inches. Stock material in these dimensions is generally commercially available. The tube 34 in an exemplary embodiment, has an external diameter of 0.0625 inches and, depending upon the specific use, may have an internal diameter tailored for such use. Suitable PEEK tubing is commercially available from Upchurch Scientific Inc with internal diameters ranging from 0.0025 inches to 0.055 inches. PEEK is one advantageous material for this application because it is easy to machine, chemically inert to most solvents which may be used in association with the electrospray equipment and processes, and is relatively temperature resistant, having a high melting temperature. It may be possible to use other materials such as polycarbonate and acrylic. The machinability facilitates providing features for accommodating conductive end pieces such as the reduced diameter portions 50 for receiving end caps 60.

The end caps may advantageously be formed of stainless steel which is relatively inexpensive and corrosion resistant. In the illustrated embodiment, the aperture 70 has a diameter of 0.02 inches. Advantageously the diameter of the aperture 70 of the downstream end cap 60 is at least as great as the internal diameter of the tube 34 so as to avoid interfering with flow through the tube, but less than the external diameter of the tube so that it presents a barrier to downstream movement of the tube, preventing the tube from being sucked or otherwise propelled by the pressure difference into the low pressure region 8.

Figure 4:
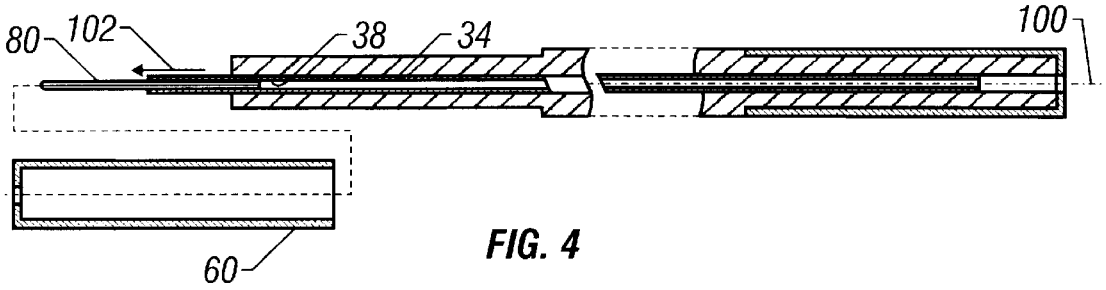
FIG. 4 is a partially exploded and cut-away cross-sectional view of the capillary of FIG. 3, with an end cap removed and showing an insert removal tool.

FIG. 4 shows how to remove the tube. The end cap 60 at the upstream end of the capillary is first removed. This step may be omitted if the aperture 70 of the upstream end cap is larger than the outer diameter of the capillary tube 34. A removal tool (not shown) having a removal shaft 80 is inserted into the tube so as to firmly engage the tube's inner surface 38. This firm engagement may be obtained by a friction fit due to the diameter of the shaft, or by the provision of a slight torque orthogonal to the axis 100, or by any other appropriate means such as bonding the shaft to the tube using an adhesive such as cyanoacrylate. Stiff steel wire may provide an acceptable removal tool. Once engaged, an axial withdrawal force is applied in the upstream direction 102 so as to withdraw the tube from the sleeve. Once the tube is withdrawn, a replacement tube may be inserted into the sleeve.

If the entire capillary is removed, an opening equal to its cross-sectional area is formed between the low pressure chamber vacuum 8 and the substantially atmospheric pressure spray chamber 2. This would likely allow a substantial increase in the pressure in the vacuum pressure chamber which, depending upon the pumping equipment provided, could take days to reverse. This situation often exists when using current technology. The pressure increase corresponds to the flow area, and thus to the square of the radius of the opening. By withdrawing only the inner capillary tube 34, a much smaller opening is formed, leading to a smaller increase in pressure which may be more easily overcome by the vacuum pump. With reference to the exemplary dimensions given above, the cross-sectional area of a 0.25 inch diameter capillary is 0.0491 square inches, while that of a 0.0625 inch diameter inner capillary tube is 0.00307 square inches for a ratio of 16 to 1. However, the exemplary cross-sectional area of aperture 70 of the downstream end cap is 0.000314 square inches. Relative to the cross-sectional area of the capillary, this presents a 156 to 1 reduction in cross-sectional area through which air can flow during changeout.

By facilitating such an in situ change, a number of options become available to the user. For example, a dirty or damaged capillary tube 30 may be replaced by an otherwise identical but clean tube. For varied experimental purposes an undamaged tube may be replaced by a tube of different internal diameter or by a tube of different properties such as replacing a dielectric PEEK or glass tube with a conductive stainless steel tube.

Figure 5:
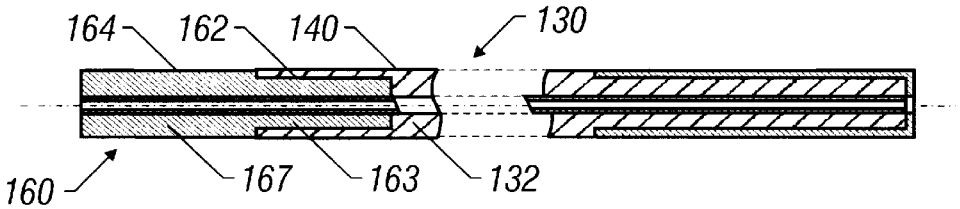
FIG. 5 is a cut-away cross-sectional view of a second capillary according to one embodiment of the invention.

Another capillary 130, shown in FIG. 5, comprises a conductive end piece formed as a plug 160 rather than a cap. Like the end cap 60 in FIG. 3, the plug 160 is removable. The plug 160 is formed as the unitary combination of a head 164, 167 with a cylindrical outer surface 165 at the end of the capillary and a shaft 163 having a cylindrical outer surface 162 extending inboard from the head. The cylindrical head surface 164 is of substantially the same diameter as the outer surface 140 of the capillary sleeve 132. The cylindrical shaft surface 162 is sized to be encompassed by and in circumferential engagement with an enlarged internal diameter portion or bore 150 of the outer capillary sleeve 132. A central aperture or bore 170 extends longitudinally through the plug and is of substantially the same diameter as the internal surface 136 of the sleeve 132 so as to allow it to encompass and maintain circumferential engagement with the capillary tube 134.

Figure 6:
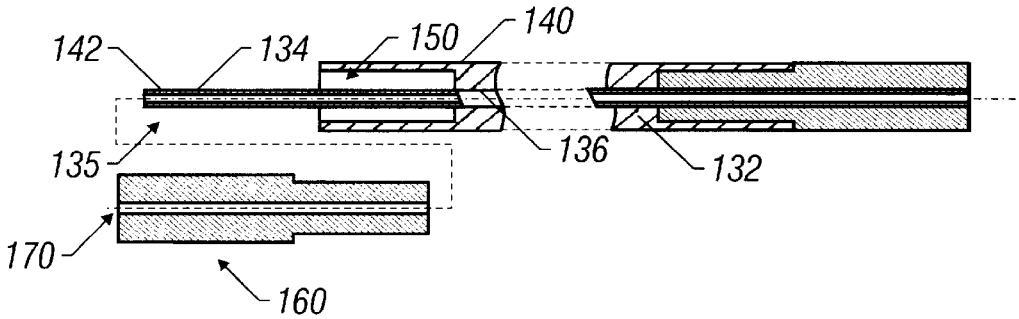
FIG. 6 is a partially exploded and cut-away cross-sectional view of a third capillary.

Another capillary, shown in FIG. 6 features end plugs as both upstream and downstream conductive end pieces. Removal of the upstream plug may expose an upstream end portion 135 of the tube 134, facilitating the removal of the tube by gripping its outer surface 142 with, for example, pliers. Such end plugs, used at the upstream end or at both ends, may be advantageous when used with conductive inner capillary tubes for establishing excellent electrical contact with such tubes. Additionally, the plug may be integrally (or even unitarily) formed with the tube so that removal of the plug and tube are simultaneous.

Figure 7:
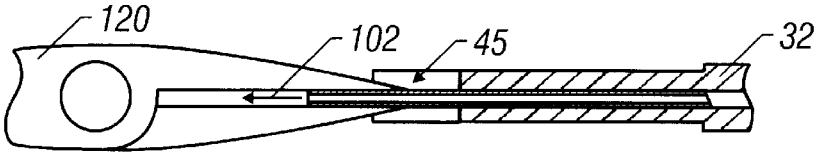
FIG. 7 is a partial exploded and cut-away cross-sectional view of a fourth capillary.

FIG. 7 shows a modification to the basic construction of the capillary of FIG. 3 (and a departure from its radial symmetry). This facilitates removal of the tube 34 via a gripping of its outer surface by providing a longitudinal notch or slot 45 in the outer capillary sleeve 32 extending downstream from the upstream end 112 of the capillary. This would allow the insertion of the jaws of a needle nose pliers 120 at opposite sides of the slot.

A number of embodiments of the present invention have been described. Nevertheless, it will be understood that various modifications may be made without departing from the spirit and scope of the invention. For example, many alternative materials such as polytetrafluoroethylene, polyethylene, acetal resin, acrylics, polycarbonate, glass or ceramics are all among materials which may be potentially used. Titanium or steel may be used for the tube when it is desired to apply small voltage difference across the capillary to provide a limited resistive heating of the capillary. Accordingly, other embodiments are within the scope of the following claims.

What is claimed is:

1. A method for remanufacturing a capillary for use with an ion electrospray source for a mass spectrometer comprising:

providing a capillary having a generally concentric outer capillary sleeve and inner capillary tube;

using the capillary to guide ions from the source to a relatively low pressure region, the ions passing along an upstream to downstream path through the inner capillary tube;

stopping the flow of ions through the inner capillary tube;

engaging the inner capillary tube;

applying an axial withdrawal force to the inner capillary tube so as to withdraw the inner capillary from the outer capillary sleeve with the outer capillary sleeve in situ, wherein a first end of the outer capillary with the inner capillary removed is exposed to substantially atmospheric pressure and a second end of the outer capillary remains with the inner capillary removed under vacuum;

providing a replacement inner capillary tube; and inserting the replacement inner capillary tube into the outer capillary sleeve.

2. The method of claim 1 wherein the step of engaging the inner capillary tube comprises inserting a removal shaft into the tube.

3. The method of claim 2 wherein the shaft bears a substance for bonding the shaft to the tube.

4. The method of claim 3 therein the substance is an adhesive.

5. The method of claim 4 wherein the removal shaft is a wire.

6. The method of claim 1 further comprising:

removing a conductive end piece from the first end of the capillary.

7. The method of claim 6 wherein the conductive end piece is removed prior to withdrawal of the inner capillary tube from the outer capillary sleeve.

8. The method of claim 6 wherein the conductive end piece is removed simultaneously to the withdrawal of the inner capillary tube from the outer capillary sleeve.

9. The method of claim 1 wherein the step of engaging the inner capillary tube comprises gripping an outer surface portion of the inner capillary tube.

10. The method of claim 1 wherein the inner capillary tube and replacement inner capillary tube are formed of different materials.

11. The method of claim 1 wherein the inner capillary tube and replacement inner capillary tube have different internal diameters.

12. A capillary for use with an electrospray ion source, the capillary having a first end, a second end, a capillary length, an inner surface and an outer surface and comprising:

an inner capillary tube, having a substantially cylindrical inner surface which, over substantially the entire capillary length, forms the inner surface of the capillary;

an outer capillary sleeve, having an outer cylindrical surface which over substantially the entire capillary length forms the outer surface of the capillary;

a first conductor at the first end of the capillary; and a second conductor at the second end of the capillary, wherein the inner capillary tube is formed in a way as to enable removal of the inner capillary tube from the outer capillary sleeve without damage to the outer capillary sleeve.

13. The capillary of claim 12 wherein the capillary sleeve is formed of polyetheretherketone.

14. The capillary of claim 13 wherein the capillary tube is formed of polyetheretherketone.

15. The capillary of claim 13 wherein the capillary tube is formed of glass.

16. The capillary of claim 13 wherein the capillary tube is formed of stainless steel.

17. The capillary of claim 13 wherein the capillary tube is formed of metal.

18. The capillary of claim 13 wherein the first and second conductors are formed of stainless steel.

19. A capillary as in claim 12, further comprising a vacuum pump producing a vacuum at one end of said outer capillary sleeve, and wherein an inner diameter of said outer capillary sleeve is effective to allow vacuum from said vacuum pump to substantially remain even when said inner capillary tube is removed.

20. A capillary for use with an electrospray ion source, the capillary having a first end, a second end, a capillary length, an inner surface and an outer surface and comprising:

an inner capillary tube, having a substantially cylindrical inner surface which, over substantially the entire capillary length, forms the inner surface of the capillary;

an outer capillary sleeve, having an outer cylindrical surface which over substantially the entire capillary length forms the outer surface of the capillary;

a first conductor at the first end of the capillary; and a second conductor at the second end of the capillary, wherein the inner capillary tube is formed in a way as to enable removal of the inner capillary tube from the outer capillary sleeve without damage to the outer capillary sleeve, wherein at least one of the first and second conductors is formed by a metal end cap comprising of the unitary combination of a tubular body and a centrally apertured end plate, the body encompassing and in circumferential engagement with a reduced diameter portion of the outer capillary sleeve and having an external diameter substantially the same as said second diameter.

21. A capillary for use with an electrospray ion source, the capillary having a first end, a second end, a capillary length, an inner surface and an outer surface and comprising:

an inner capillary tube, having a substantially cylindrical inner surface which, over substantially the entire capillary length, forms the inner surface of the capillary;

an outer capillary sleeve, having an outer cylindrical surface which over substantially the entire capillary length forms the outer surface of the capillary;

a first conductor at the first end of the capillary; and a second conductor at the second end of the capillary, wherein the inner capillary tube is formed in a way as to enable removal of the inner capillary tube from the outer capillary sleeve without damage to the outer capillary sleeve, wherein at least one of the first and second conductors is formed by a metal end plug comprising the centrally apertured unitary combination of a cylindrical shaft and head, the shaft encompassed by and in circumferential engagement with an enlarged internal diameter portion of the outer capillary sleeve, the central apertured portion encompassing and in circumferential engagement with the capillary tube, and the head having an external diameter substantially the same as said second diameter.

22. A capillary for use with an electrospray ion source, the capillary having:

an inner cylindrical surface having a first diameter;

an outer cylindrical surface having a second diameter;

a first conductor at a first end; and a second conductor at a second end, wherein at least an outer portion of the capillary, including the outer cylindrical surface is formed of polyetheretherketone, wherein the first and second conductors are stainless steel, and wherein said outer portion which is formed of polyetheretherketone is an outer capillary sleeve, substantially annular in section over at least a major portion of its length, and wherein the capillary further comprises an inner capillary tube, substantially annular in section over at least a major portion of its length and concentric with the sleeve, an outer surface of the tube engaging an inner surface of the sleeve and an inner surface of the tube and an outer surface of the sleeve substantially defining said inner and outer cylindrical surfaces, respectively, and wherein said inner tube is removable relative to the outer sleeve.

* * * * *